US006702506B2

(12) United States Patent
Iitsuka

(10) Patent No.: US 6,702,506 B2
(45) Date of Patent: Mar. 9, 2004

(54) BELT CLIP FOR PORTABLE ELECTRONIC EQUIPMENT

(75) Inventor: Yoshitune Iitsuka, Yokohama (JP)

(73) Assignee: Vertex Standard Co., Ltd. (JP)

( * ) Notice: Subject to any disclaimer, the term of this patent is extended or adjusted under 35 U.S.C. 154(b) by 0 days.

(21) Appl. No.: 09/773,958

(22) Filed: Jan. 31, 2001

(65) Prior Publication Data

US 2001/0012471 A1 Aug. 9, 2001

(30) Foreign Application Priority Data

Feb. 9, 2000 (JP) ..... 2000-031437

(51) Int. Cl.[7] ..... B25G 3/18

(52) U.S. Cl. ..... 403/325; 403/79; 403/326; 403/322.4; 24/3.11; 16/285

(58) Field of Search ..... 403/321, 322.1, 403/322.4, 325, 326, 327, 330, 79, 52; 16/285; 24/3.11, 312, 67.7, 510

(56) References Cited

U.S. PATENT DOCUMENTS 4,733,987 A * 3/1988 Tomlinson et al. ..... 403/326
4,741,074 A * 5/1988 Budano et al. ..... 24/3.11
4,745,662 A * 5/1988 Chang ..... 24/67.7
5,052,081 A * 10/1991 Fuehrer ..... 24/3.11
5,058,242 A * 10/1991 Liu et al. ..... 24/67.7
5,549,127 A * 8/1996 Chang ..... 132/277
6,152,642 A * 11/2000 Berthold et al. ..... 403/155
6,164,169 A * 12/2000 Goff ..... 81/177.85

* cited by examiner

*Primary Examiner*—Lynne H. Browne
*Assistant Examiner*—Jori Schiffman
(74) *Attorney, Agent, or Firm*—Fulwider Patton Lee & Utecht, LLP

(57) ABSTRACT

In a belt clip for portable electronic equipment by use of rewind urging force of a torsion coil spring, a detachment preventing mechanism of a guide shaft, serving as a shaft center of a rotational mechanism, is implemented with a simple structure so as to improve a reduction in the number of parts and yield. The respective shaft support portions 11*a* and 12*a* of a hang stopper plate 1 and both side plates 13*a* and 14*a* of a bracket 4 are combined with each other, a torsion coil spring 3 is twisted from a natural state and interposed therebetween in such a manner that a guide rod 21 is passed through a space formed therebetween, but movement of the torsion coil spring 3 to an axial direction and a change in a coil length are restrained by a groove 15 of the hang stopper plate 1 and the side plate 13*a* of the bracket 4. Therefore, the torsion coil spring 3 is skewed in the twisted state and a round line 31*c* of the end portion is pressed to the guide rod 21, but a concave groove 21*a* is formed at the corresponding position of the guide rod 21, and the round line 31*c* is fitted into the concave groove 21*a* to stop the guide rod 21.

11 Claims, 4 Drawing Sheets

BELT CLIP FOR PORTABLE ELECTRONIC EQUIPMENT

BACKGROUND OF THE INVENTION

1. Field of the Invention

The present invention relates to a clip for attaching electronic equipment such as a portable transceiver and the like to a belt, and particularly to improvement for simplifying a detachment preventing mechanism of shaft center (guide rod) of a torsion coil spring from being detached in a case where supporting power is obtained by use of rewinding force of the torsion coil spring.

2. Description of the Related Art

In accordance with the rapid progress of semiconductor manufacturing technology, miniaturization of portable radio apparatus such as a transceiver and the like and various kinds of measuring instruments have been remarkably done in recent years. A belt clip is attached to such electronic equipment beforehand, and a user often carries the electronic equipment in a state that the electronic equipment is hung on the belt by the clip at a nonuse time.

In other words, the size or weight is too large in order to put it into the pocket. Or, in the case where the electronic equipment is put in a bag and the like, it is inconvenient to take out the electronic equipment from the bag every time it is need. For this reason, attachment of electronic equipment to a waist portion or a belly portion is the simplest and easiest way.

For example, in a conventional small-sized portable transceiver, a clip mechanism is attached to a back face of a housing as shown in FIGS. 4 and 5.

In FIG. 4, numeric symbol 50 denotes a transceiver main body, and a hang stopper plate 1 is fixed to a back face 50*a* through a rotational mechanism 2.

As shown in FIG. 5, the rotational mechanism 2 is composed of a torsion coil spring 3, a bracket 4, and a pressure rod 5. Both side plates 13*a* and 14*a* of the rectangular U-shaped bracket 4 are combined at the inner side of shaft support portions 11*a* and 12*a*, which are formed to be protruded to both side portions of the hang stopper plate 1. The torsion coil spring 3 is placed in a space formed therebetween in the combined state. The pressure rod 5 is passed through holes 11*b* and 12*b*, which are formed on the shaft support portions 11*a* and 12*a*, holes 13*b* and 14*b* of both side plates 13*a* and 14*a* of the bracket 4 and the interior of the torsion coil spring 3 so as to achieve an assembly.

Here, the hang stopper plate 1 is configured as shown in FIG. 6. The shaft support portions 11*a* and 12*a* are formed as mentioned above, and a groove 15, into which an arm 3*a* of the torsion coil spring 3 is fitted, is formed on the surface of the combination side with the bracket 4. Further, holes 17*a* and 17*b* are formed at positions corresponding to holes 16*a* and 16*b* (FIG. 5), which are formed on an attaching plate 16 of the bracket plate 4 in a state of combination with the bracket 4.

Then, the pressure rod 5 is passed therethrough and the rotational mechanism (torsion coil spring 3 and bracket 4) is combined with the hang stopper plate 1. In this state, as shown in FIG. 5, screws 18*a* and 18*b* for attachment are passed through the holes 17*a* and 17*b* of the hang stopper plate 1, so that the bracket 4 is fastened to the back face 50*a* of the transceiver main body 50. A state after the attachment is illustrated by FIG. 7.

As shown in the figure, on the back face 50*a* of the transceiver main body 50, screw holes 51*a* and 51*b* are formed at positions corresponding to the holes 16*a* and 16*b* of the attaching plate 16 of the bracket 4. There is also formed a concave portion 52 into which an angle portion 4*c*, which is formed at an upper end of the attaching plate 16 of the bracket 4, is fitted. The hang stopper plate 1 and the rotational mechanism 2 are tightened with screws 18*a* and 18*b* for attachment in a state that the angle portion 4*c* of the bracket 4 is fitted into the concave portion 52 of the transceiver main body 50.

In this case, both side plates 13*a* and 14*a* of the bracket 4 in the rotational mechanism 2 are engaged with the hang stopper plate 1 to be opened within the fixed limit when rotating around the axis of the pressure rod 5. For this reason, the torsion coil spring 3 is loaded in a state that the torsion coil spring 3 is twisted from a natural state (state that the arm 3*a* is rotated in a direction of arrow).

Therefore, in the rotational mechanism 2, the rewinding force of the torsion coil spring 3 is used as a restoration urging force. As shown in FIG. 7, when the upper side of the hang stopper plate is pressed to the back face 50*a* of the transceiver main body 50, the lower end of the hang stopper plate 1 is rotated in a direction of an open angle, so that a belt 60 can be received. When the pressing force is removed, the hang stopping plate 1 is returned to the original state, and the belt 60 is in a state that it is supported.

In addition, as shown in FIG. 6, a hook portion 19 is formed at the lower end of the hang stopping plate 1. Unless the hang stopping plate 1 is rotated in the direction of the open angle, the hang stopping plate 1 is designed not to be detached.

By the way, seeing the rotational mechanism 2 shown in FIG. 7 in a plane, the result is shown in FIG. 8 (the portion of hang stopping plate 1 is shown by the cross-section). The detachment preventing mechanism of pressure rod 5 is implemented by fitting a top end portion 5*a* into the hole 12*b* formed on the shaft support portion 12*a* of the hang stopping plate 1 and by pressing a knurled portion 5*b* of the other end to the hole 11*b* formed on the shaft support portion 12*b*.

Therefore, the relationship of a loose fining is established between the hole 12*b* of the other shaft support portion 12*a* and the shaft portion of the pressure rod 5. However, the hole 11*b* of the shaft support portion 11*a* has an inner diameter, which is slightly smaller than the shaft diameter of the knurled portion 5*b*. A crack is easily generated on the shaft support portion 11*b* when the knurled portion 5*b* is pressed, with the result that there occurs a case in which the shaft support portion 11*b* is broken at a clip using time.

Moreover, the pressing process is completed in such a manner that the knurled portion 5*b* is protruded a little. For this reason, there is a problem, for example, in which the protruded portion is caught on a dress at the time of detaching the transceiver main body 50 from the belt 60.

In contrast, as shown in FIG. 9, there is adopted a system in which a round rod 6 having grooves 6*a* and 6*b* on an outer peripheral surface of both end portions is used in place of the pressure rod 5 and E-rings 7*a* and 7*b* are fitted into the grooves 6*a* and 6*b* after attaching the rotation mechanism 2 to the hang stopping plate 1, thereby constituting the detachment preventing mechanism.

In this system, there can be considered a structure in which E-ring fitting means is used in only one end, and the other end is used as a thin head portion.

In these systems, it is enough that the round rod 6 is loosely fitted into the holes 11*b* and 12*b* of the respective shaft support portions 11*a* and 12*a*, and there is no possibility that the crack will be generated unlike the above-mentioned case. However, the E-rings 7*a* and 7*b* are needed separately as an assembly part, and the protruded portion is also formed on the side face. For this reason, similar to the above-mentioned case, the problem occurs at the time of detaching the transceiver main body 50 from the belt 60.

It is an object of the present invention to implement a detachment preventing mechanism of a shaft (corresponding to the aforementioned pressure rod 5, round rod 6, and corresponding to a guide rod with respect to the torsion coil spring 3) with an extremely simple structure, to manufacture a belt clip of portable electronic equipment with a good yield at reasonable cost in general, and to prevent occurrence of a problem, for example, in which a part of the equipment is caught on a dress at the time of detaching the portable electronic equipment.

SUMMARY OF THE INVENTION

The present invention relates a belt clip for portable electronic equipment in which a pair of shaft support portions, each having a fixed distance with respect to each opposite face of portable electronic equipment and a hang stopper plate, is structured to be protruded, and a guide rod is passed through holes formed on each of shaft support portions and an interior of a torsion coil spring mounted in a space formed between the pair of the respective shaft support portions in a state that the respective shaft support portions of portable electronic equipment and those of the hang stopper plate are combined with each, and the torsion coil spring is mounted to urge the respective opposite faces of the portable electronic equipment and the hang stopper plate where the respective arms are placed on the same side with respect to the guide rod in a state that the torsion coil spring is twisted from a natural state, the belt clip for portable electronic equipment comprises a constraint mechanism, which is formed on the faces of the portable electronic equipment side and the hang stopper plate where the respective arms of the torsion coil spring contact, for restraining movement of the guide rod of the torsion coil spring to an axial direction and a change in a coil length of the torsion coil spring generated by its mounting, wherein an outer diameter of the guide rod is set to a size such that a coil axis of the torsion coil spring mounted under the constraint conditions is inclined and at least an end portion of the torsion coil spring presses an outer peripheral surface of the guide rod, and a concave portion is formed at a position corresponding to the end portion of the torsion coil spring in the guide rod, so that the end portion is engaged with the concave portion.

According to the present invention, movement of the torsion coil spring to the axial direction of the guide rod is restrained by the restraint mechanism formed on the face of the portable electronic equipment and that of the hang stopping plate (constraint condition 1) and the change in the coil length is restrained (constraint condition 2), and the torsion coil spring is mounted in a state that it is twisted from the natural state under these conditions.

Therefore, the torsion coil spring is mounted in a state that the respective round line portions of the torsion coil spring are skewed by stress generated in a spring element wire based on constraint condition 2, and the coil axis is inclined.

On the other hand, the outer diameter of the guide rod is set to a size such that at least the end portion of the torsion coil spring presses the outer peripheral surface of the guide rod.

Then, in this embodiment, the concave portion is formed at a position corresponding to the end portion of the torsion coil spring in the guide rod. For this reason, the end portion of the torsion coil spring is pressed to the concave portion, so that the end portion is fitted into the concave portion. However, movement of the torsion coil spring to the axial direction of the guide rod is also restrained by (constraint condition 1).

As a result, the guide rod is stopped by the torsion coil spring whose movement is restrained, and the detachment preventing mechanism of the guide rod can be formed.

In this invention, "the pair of shaft support portions formed on the portable electronic equipment side" does not always have to form on the electronic equipment main body directly, and the shaft support portions, which have holes on both side plates of the rectangular U-shaped bracket fixed to the face of the electronic equipment, may be used.

Moreover, as a "restraint mechanism", any structure may be used if the mechanism implements the restraint conditions 1 and 2. However, more rational and simple mechanism can be implemented by forming the constraint mechanism of a wall surface of a space for mounting the torsion coil spring at the shaft support portions on the portable electronic equipment side or the hang stopper plate side, and a fitting groove of the arm, which is formed on the surface of the portable electronic equipment side with which the arm of the torsion coil spring comes in contact or the surface of the hang stopper plate side.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

A preferred embodiment of the present invention will now be described specifically with reference to FIGS. 1 through 3.

Figure 1:
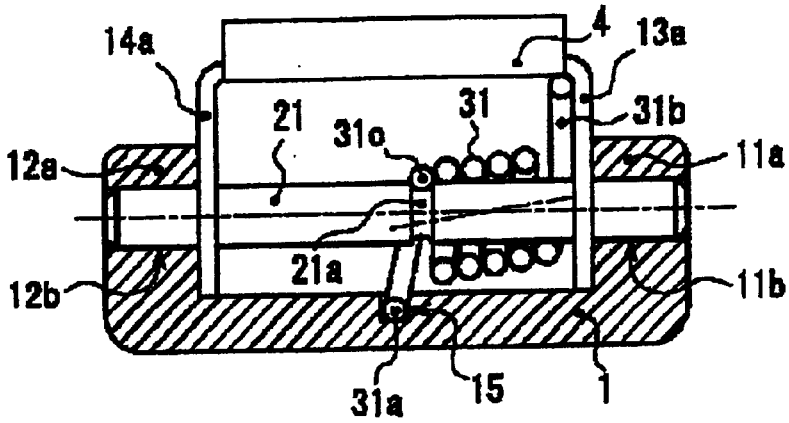
FIG. 1 is a plane view showing a rotational mechanism portion according to a clip of the present embodiment.
Figure 8:
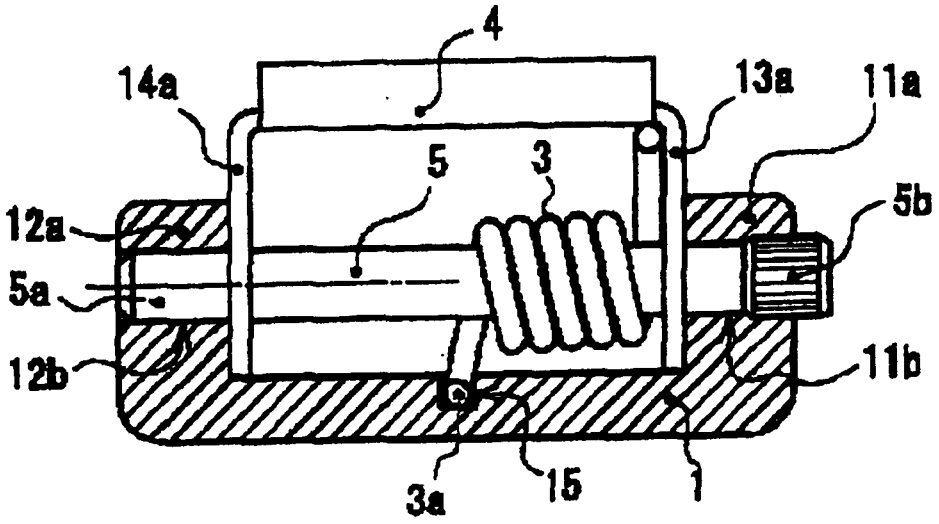
Fig 8 (PRIOR ART)
FIG. 8 is a plane view of a rotational mechanism (detachment prevention is a pressing system of a knurled portion) in prior art.
Figure 9:
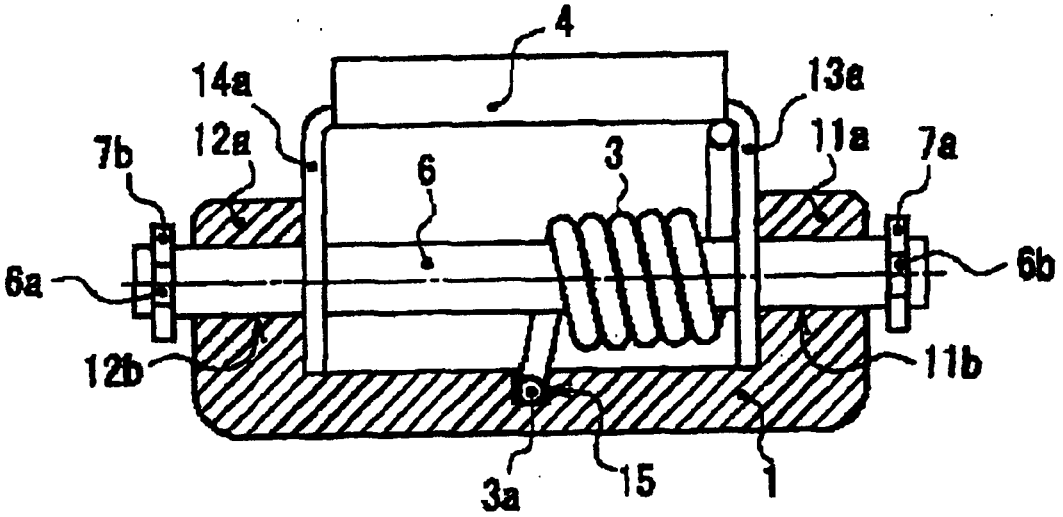
Fig 9 (PRIOR ART)
FIG. 9 is a plane view of a rotational mechanism (detachment prevention is an E-ring fitting system) in prior art.

First, FIG. 1 is a plane view showing a rotational mechanism portion according to a clip of a small-sized portable transceiver, and corresponds to FIGS. 8 and 9 relating to the prior art.

In addition, FIG. 1 also illustrates a portion of the torsion coil spring 31 by a cross-section.

In this embodiment, the basic structure of the hang stopping plate 1 and the bracket 4 is the same as that of the prior art. However, this embodiment has the features in the following points.

Namely, as a rod, which corresponds to the pressure rod 5 or round rod 6 of the prior art, there is used a guide rod 21 having a concave groove 21*a* formed on the outer peripheral surface corresponding to the position of round line 31*c*, which is continued from an arm 31*a* of a torsion coil spring 31. Moreover, the length of the guide rod 21 is set to a width of the hang stopping plate 1.

Figure 2:
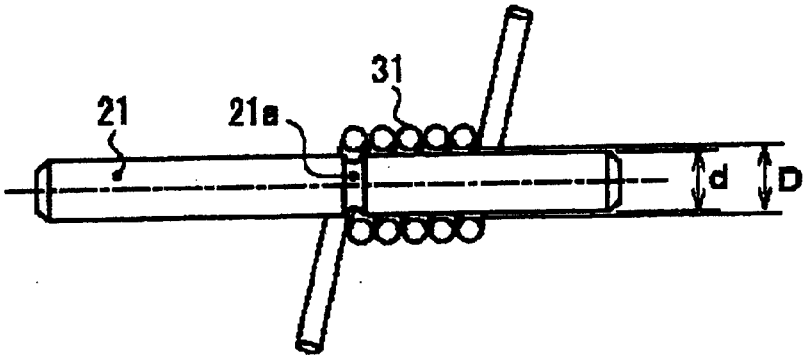
FIG. 2 is a view showing a relationship between an inner diameter of a torsion coil spring and an outer diameter of a guide rod in a natural state.
Figure 3:
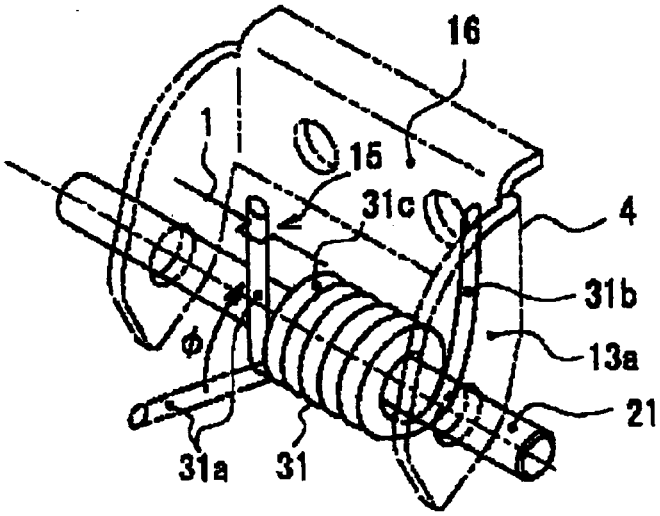
FIG. 3 is a schematic perspective view showing a state in which the torsion coil spring is mounted with torsion from the natural state and movement to an axial direction and a change in a coil length are constrained.
Figure 4:
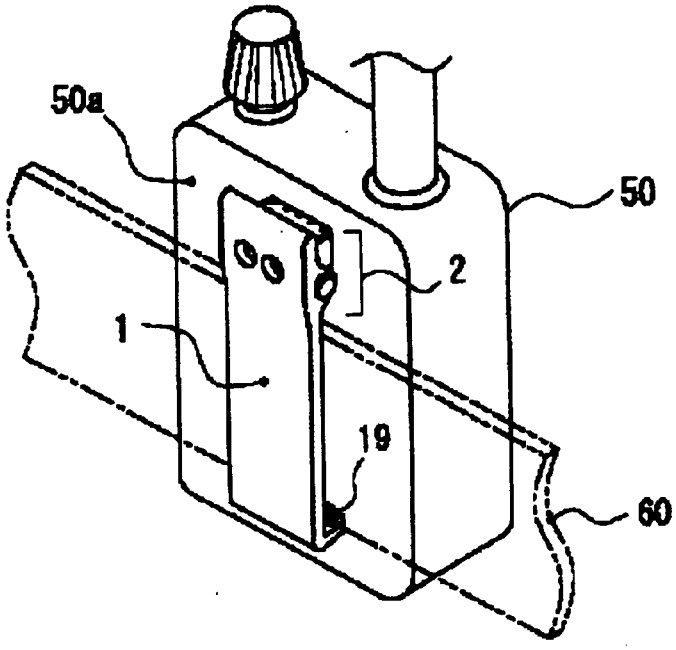
Fig4 (PRIOR ART)
FIG. 4 is an external perspective view of a small-sized portable transceiver to which a clip mechanism relating to prior art is attached, seeing from a back face.
Figure 5:
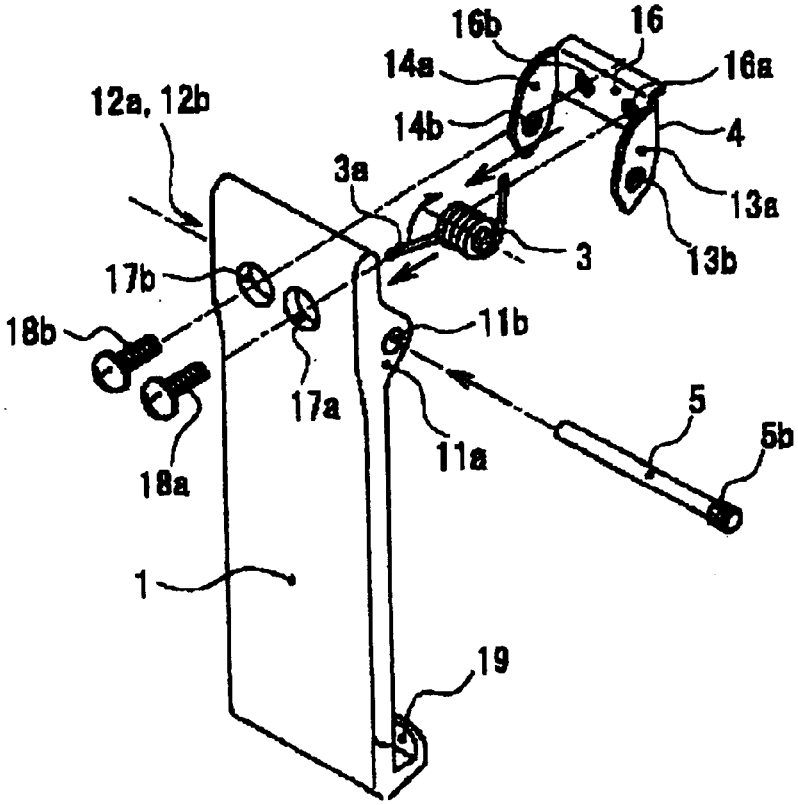
Fig5 (PRIOR ART)
FIG. 5 is an exploded perspective view of the clip mechanism of FIG. 4.
Figure 6:
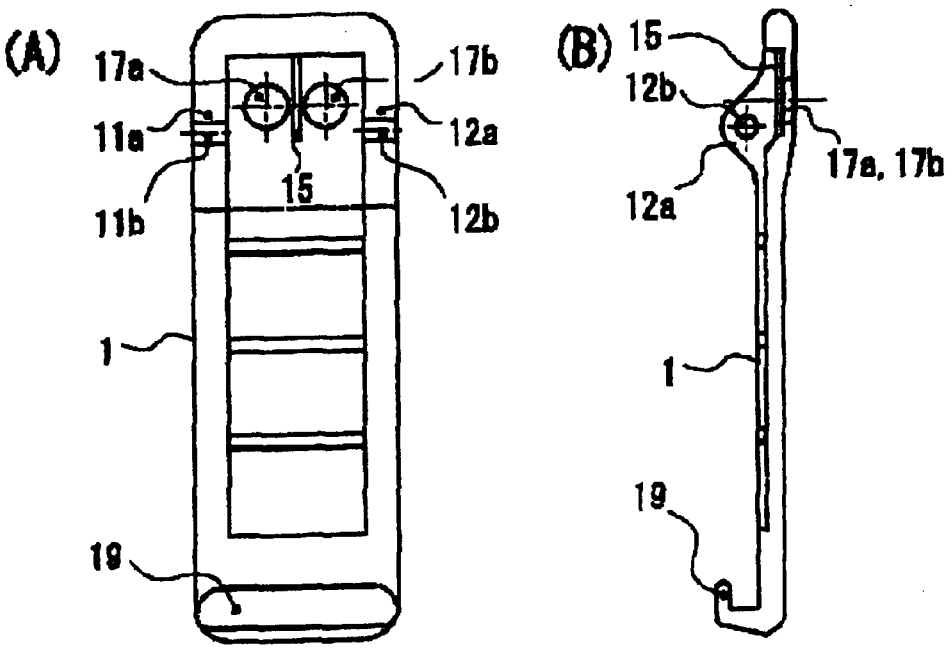
Fig 6 (PRIOR ART)
FIG. 6 is a front view (A) of a hang stopping plate and a side view (B) thereof.

Then, as shown in FIG. 2, an inner diameter D of the torsion coil spring 31 is naturally set to be larger than an outer diameter d of the guide rod 21 in a natural state. However, if the torsion coil spring 31 is mounted between the hang stopping plate 1 and the bracket 4 by the guide rod 21 as shown in FIG. 1, the arm 31*a* of the torsion coil spring 31 is twisted by an angle $\phi$ and is fitted into a groove 15 formed on the hang stopping plate 1 as shown in FIG. 3.

In other words, the arm 31*a* of the torsion coil spring 31 is stopped by the groove 15 of the hang stopping plate 1*a* portion of an arm 31*b* of the other end is stopped by an attaching plate portion 16 of the bracket 4 and is in contact with a side plate 13*a*. As a result, movement of the torsion coil spring 31 to an axial direction and a change in a coil length are constrained, and the torsion coil spring 31 is twisted by an angle $\phi$ from the natural state.

Therefore, the respective round line portions of the torsion coil spring 31 are skewed and a coil axis is inclined, and the round line portions of both ends are in a state that they press the outer peripheral surface of the guide rod 21. However, in this embodiment, since the concave groove 21*a* is formed on the guide rod 21 as mentioned above, the round line portion 31*c* continued to the arm 31*a* is fitted into the concave groove 21*a* as shown in FIG. 1 and the torsion coil spring 31 is set between the hang stopping plate 1 and the bracket 4 in this state.

As a result, movement of the torsion coil spring 31 to the axial direction is constrained, and the round line portion 31*c* is engaged with the concave groove 21*a* of the guide rod 21 to constrain movement to the axial direction of the guide rod 21. For this reason, the detachment preventing mechanism of guide rod 21 can be rationally constituted.

Figure 7:
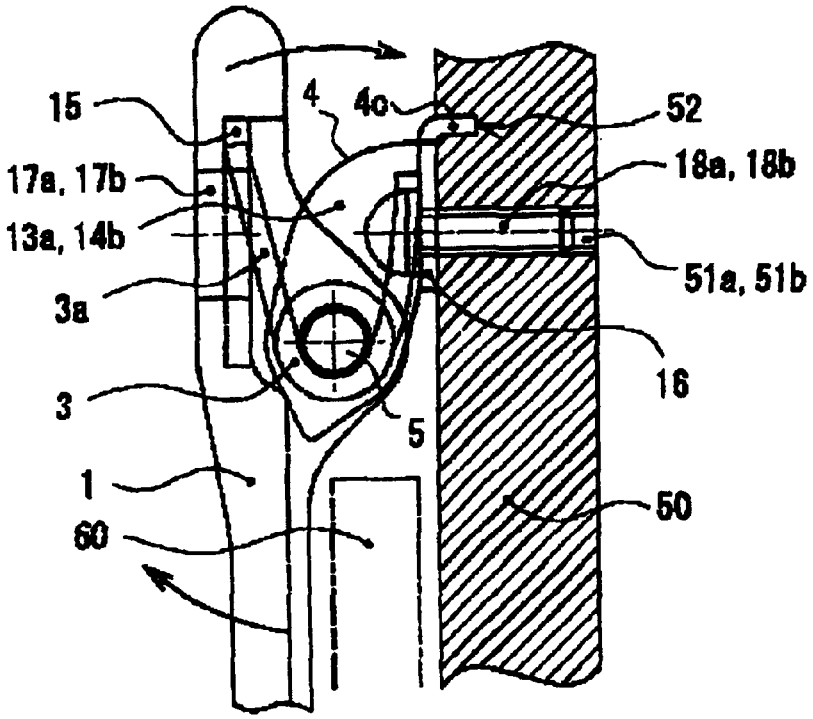
Fig 7 (PRIOR ART)
FIG. 7 is an enlarged side view showing a state in which a rotational mechanism is added to the hang stopping plate and attached to a transceiver main body.

Moreover, as shown in FIG. 7, when the hang stopper plate 1 is rotated in the direction of open angle to receive the belt 60 after being opened from the back face 50*a* of the transceiver main body 50, the torsion coil spring 31 is much largely twisted and skewed. Namely, the round line portion 31*c* of the torsion coil spring 31 is prevented from being detached from the concave groove 21*a* of the guide rod 21 by the operation of the hang stopper plate 1.

Generally, in the case of using the urging force of the torsion coil spring in the rewinding direction, the outer diameter d of the guide rod is designed to have about 90% of coil inner diameter ($D-_{\Delta}D$) at a maximum torsion time [where $_{\Delta}D=\phi$ max $D/27\pi N$ ((p max is a maximum torsion angle and N is the number of turns of coils)] such that a large load is not applied on the guide rod by the skew of the torsion coil spring. However, this embodiment makes a reverse use of this fact, and forms the detachment preventing mechanism of guide rod 21 by using the skew of the torsion coil spring 31 effectively.

Therefore, in consideration of the fact that the change in the coil length of the torsion coil spring 31 is constrained, $d>0.9(D-_{\Delta}D)$ may be set as a guide for designing the rotational mechanism of the clip relating to this embodiment.

Then, unlike the prior art, the rotational mechanism of this embodiment eliminates the need for pressing the guide rod 21 to the shaft support portions 11*a* or 12*a* and for using the E-rings. It is enough to form the concave groove 21*a* on the guide rod 21, and the assembly of rotational mechanism is extremely easy.

Furthermore, since the protruded portion is not formed on the side portion of the hang stopper plate 1, there is not generated the problem in which the protruded portion is caught on a dress at the time of detaching the transceiver main body 50 from the belt 60.

Additionally, in this embodiment, though the arm 31*a* of the torsion coil spring 31 is stopped by the groove 15 of the hang stopper plate 1, a projection for stopping may be formed on the hang stopper plate 1. Moreover, in this embodiment, though the bracket 4 is used to form the rotational mechanism to be independent of the transceiver main body 50, such shaft support portions that correspond to both side plates 13*a* and 14*a* of the bracket 4, may be directly formed on the back face 50*a* of the transceiver main body 50.

The "belt clip for portable electronic equipment" of the present invention provides the following effects by having the above structure.

More specifically, in the portable belt clip for electronic equipment, which constituting the rotational mechanism of the hang stopper plate by use of the rewind urging force of the torsion coil spring, the detachment preventing mechanism of the guide rod, which passes through the shaft support portions and the torsion coil spring, is implemented by use of a phenomenon in which the respective round line portions are skewed when the torsion coil spring is twisted from the natural state. Unlike the prior art, neither breakage of the shaft support portions nor an increase in the number of parts occurs, and the extremely simple structure and the easiness of assembly makes it possible to achieve a reduction in cost.

Furthermore, it is possible to eliminate the protruded portion from the side portion of the hang stopper plate, and this brings about an advantage in which there is not generated the problem in which the protruded portion is caught on the dress at the time of detaching the portable electronic equipment.

While several forms of the present invention have been illustrated and described, it will be apparent that various modifications may be made without departing from the spirit and scope of the invention. Therefore the scope of the invention is not to be limited to the specific embodiments disclosed herein but is to be accorded the scope and breadth of the appended claims.

What is claimed is:

1. A belt clip for portable electronic equipment having a face from which a pair of protruding shaft support portions formed with holes support a hang stopper plate having a pair of shaft receiving supports with its plate face at a fixed distance from the opposing face of the portable electronic equipment by a guide rod passing through the holes in the shaft support portions and into the shaft receiving supports whereby the hang stopper plate may be rotated relative to the portable electronic equipment face, said belt clip for portable electronic equipment comprising:

a constraint mechanism including a torsion coil spring positioned between the shaft support portions with the guide rod passing therethrough, said coil spring having a diameter greater than an outer diameter of the guide rod and including a first arm projecting from one end and a second arm projecting from its opposing end with one of the arms contacting the portable electronic equipment face and the other of the arms contacting the hang stopper plate face twisting the coil spring from a natural state urging the respective faces of the portable electronic equipment and hang stopper plate together and inclining a central axis of the coil spring to a central axis projecting through the guide rod pressing an end portion of the torsion coil spring against a single groove recessed into the outer peripheral surface of the guide rod between said shaft support portions and at a position corresponding to the end portion of the torsion coil spring constraining the axial movement of the guide rod.

2. The belt clip for portable electronic equipment according to claim 1 wherein:

the pair of shaft support portions on the portable electronic equipment face are the side plates of a rectangular U-shaped bracket fixed to the electronic equipment.

3. The belt clip for portable electronic equipment according to claim 2 wherein:

the constraint mechanism further includes a wall surface of one of the shaft support portions on the portable electronic equipment side or the hang stopper plate side and a fitting groove formed on the surface of the portable electronic equipment side or the surface of the hang stopper plate with which one arm of the torsion coil spring comes in contact and is restrained therein and the other of the arms contacts the wall surface.

4. The belt clip for portable electronic equipment according to claim 1 wherein:

the constraint mechanism further includes a wall surface of one of the shaft support portions on the portable electronic equipment side or the hang stopper plate side and a fitting groove formed on the surface of the portable electronic equipment side or the surface of the hang stopper plate with which one arm of the torsion coil spring comes in contact and is restrained therein and the other of the arms contacts the wall surface.

5. A belt clip assembly for attaching to a face of a portable electronic equipment housing, said belt clip comprising:

a shaft support including a pair of opposing, spaced apart, shaft support portions with aligned apertures and a mounting section for mounting said shaft support to said face wherein said shaft support portions protrude outwardly from said face;

an elongated hang stopping plate including opposing, spaced apart, shaft end support portions with holes, said shaft end support portions being positioned adjacent to said shaft support portion with said holes in axial alignment with said apertures;

an elongated guide rod passing through said apertures and holes forming a pivoting assembly with said hang stopping plate being rotatably movable relative to said rod support, said guide rod further including a rod diameter, a central longitudinal axis, and a single grooved region recessed into an outer peripheral surface of said guide rod and positioned between said shaft support portions; and a torsion coil spring including a first arm and a second arm terminating in an end and including a coil section having an inner diameter greater than said rod diameter and with a coil axis inclined to said central longitudinal axis and engaging an end portion of said coil section in said grooved region of said guide rod constraining axial movement of said guide rod, said coil spring mounted on said guide rod between said shaft support portions with said first end arm being abutting said shaft support and said end of said second arm abutting said hang stopping plate with said spring urging a lower end of said hang stopping plate toward said face.

6. The belt clip assembly as set forth in claim 5 wherein:

said shaft support is a U-shaped bracket with said mounting section including an attachment plate with fastener apertures.

7. The belt clip assembly as set forth in claim 6 wherein:

said hang stopping plate includes a fitting groove receiving said end of said second arm of said coil spring.

8. The belt clip assembly as set forth in claim 5 wherein:

said hang stopping plate includes a concave fitting groove receiving said end portion of said second arm of said coil spring and said first arm abuts one of said shaft support portions.

9. The belt clip assembly as set forth in claim 5 wherein:

said coil section is a continuous turn section positioned in between said first arm and said second arm.

10. A belt clip assembly kit for attaching to a housing face of a portable electronic device having a shaft support including spaced apart brackets projecting outwardly from said face and including axially aligned holes, said belt clip assembly kit comprising:

an elongated hang stopping plate including a pair of spaced apart rod supports with apertures to be aligned with a central bracket of said holes in said brackets, a guide rod to be inserted through said holes and apertures forming a pivoting assembly wherein said hang stopping plate may be rotated relative to said shaft support, said guide rod including a single groove recessed into an outer peripheral surface of said guide rod and positioned between said rod supports; and a coil spring having a coil section to be mounted on said guide rod between said rod supports and having a coil axis and terminating in a first arm and an opposing second arm, one end of said coil section engaging said groove with said coil axis inclined to a central longitudinal axis projecting through said guide rod and said first arm abutting one of said supports and said second arm abutting an interior side of said hang stopping plate, when said hang stopping plate, guide rod, and coil spring are attached to said shaft support.

11. An electronic portable device with belt clip comprising:

a portable device with a housing including a face with protruding, spaced apart shaft supports having apertures arranged in axial alignment to one another;

an elongated hang stopping plate including opposing, spaced apart, shaft end support portions with holes, said shaft end support portions being positioned adjacent to said shaft supports with said holes in axial alignment with said apertures;

an elongated guide rod passing through said apertures and holes forming a pivoting assembly with said hang stopping plate being rotatably movable relative to said rod support, said guide rod further including a central longitudinal axis and a single grooved region positioned between said shaft support portions and recessed into an outer peripheral surface of said guide rod; and a torsion coil spring including a first arm and a second arm and including a coil section having a coil axis inclined to said central longitudinal axis and engaging an end portion of said coil section in said single grooved region of said guide rod constraining axial movement of said guide rod, said coil spring being mounted on said guide rod between said shaft support portions with said first end arm abutting said shaft support and said second arm abutting said hang stopping plate with said spring urging a lower end of said hang stopping plate toward said face.

* * * * *